US006884152B2

(12) United States Patent
Ramarajan

(10) Patent No.: US 6,884,152 B2
(45) Date of Patent: Apr. 26, 2005

(54) APPARATUSES AND METHODS FOR CONDITIONING POLISHING PADS USED IN POLISHING MICRO-DEVICE WORKPIECES

(75) Inventor: Suresh Ramarajan, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/365,086

(22) Filed: Feb. 11, 2003

(65) Prior Publication Data

US 2004/0157538 A1 Aug. 12, 2004

(51) Int. Cl.[7] ..... B24B 1/00

(52) U.S. Cl. ..... 451/41; 451/57; 451/287; 451/443; 451/444

(58) Field of Search ..... 451/56, 443, 444, 451/41; 15/29, 21.1, 180

(56) References Cited

U.S. PATENT DOCUMENTS

| | | | | |
|---|---|---|---|---|
| 5,020,283 | A | 6/1991 | Tuttle | |
| 5,069,002 | A | 12/1991 | Sandhu et al. | |
| 5,081,796 | A | 1/1992 | Schultz | |
| 5,177,908 | A | 1/1993 | Tuttle | |
| 5,232,875 | A | 8/1993 | Tuttle et al. | |
| 5,234,867 | A | 8/1993 | Schultz et al. | |
| 5,240,552 | A | 8/1993 | Yu et al. | |
| 5,244,534 | A | 9/1993 | Yu et al. | |
| 5,245,790 | A | 9/1993 | Jerbic | |
| 5,245,796 | A | 9/1993 | Miller et al. | |
| RE34,425 | E | 11/1993 | Schultz | |
| 5,297,364 | A | 3/1994 | Tuttle | |
| 5,421,769 | A | 6/1995 | Schultz et al. | |
| 5,433,651 | A | 7/1995 | Lustig et al. | |
| 5,449,314 | A | 9/1995 | Meikle et al. | |
| 5,456,627 | A | * 10/1995 | Jackson et al. | 451/11 |
| 5,486,129 | A | 1/1996 | Sandhu et al. | |
| 5,514,245 | A | 5/1996 | Doan et al. | |
| 5,531,635 | A | * 7/1996 | Mogi et al. | 451/72 |
| 5,533,924 | A | 7/1996 | Stroupe et al. | |
| 5,540,810 | A | 7/1996 | Sandhu et al. | |
| 5,609,718 | A | 3/1997 | Meikle | |
| 5,616,069 | A | 4/1997 | Walker et al. | |
| 5,618,381 | A | 4/1997 | Doan et al. | |
| 5,618,447 | A | 4/1997 | Sandhu | |
| 5,624,303 | A | 4/1997 | Robinson | |
| 5,643,060 | A | 7/1997 | Sandhu et al. | |
| 5,645,682 | A | 7/1997 | Skrovan | |
| 5,655,951 | A | 8/1997 | Meikle et al. | |
| 5,658,183 | A | 8/1997 | Sandhu et al. | |

(Continued)

OTHER PUBLICATIONS

Kondo, S. et al., "Abrasive–Free Polishing for Copper Damascene Interconnection," Journal of The Electrochemical Society, vol. 147, No. 10, pp. 3907–3913, 2000, The Electrochemical Society, Inc.

*Primary Examiner*—George Nguyen
(74) *Attorney, Agent, or Firm*—Perkins Coie LLP

(57) ABSTRACT

Apparatuses and methods for conditioning polishing pads used in polishing micro-device workpieces are disclosed herein. In one embodiment, an end effector for conditioning a polishing pad includes a member having a first surface and a plurality of contact elements projecting from the first surface. The member also includes a plurality of apertures configured to flow conditioning solution to the polishing pad. The apertures can extend from the first surface to a second surface opposite the first surface. The member can further include a manifold that is in fluid communication with the apertures. In another embodiment, a conditioner for conditioning the polishing pad includes an arm having at least one spray nozzle configured to spray conditioning solution onto the polishing pad and an end effector coupled to the arm. The end effector includes a first surface and a plurality of contact elements projecting from the first surface.

26 Claims, 5 Drawing Sheets

U.S. PATENT DOCUMENTS 5,658,190 A 8/1997 Wright et al.
5,664,988 A 9/1997 Stroupe et al.
5,679,065 A 10/1997 Henderson
5,690,540 A 11/1997 Elliott et al.
5,700,180 A 12/1997 Sandhu et al.
5,702,292 A 12/1997 Brunelli et al.
5,725,417 A 3/1998 Robinson
5,730,642 A 3/1998 Sandhu et al.
5,733,176 A 3/1998 Robinson et al.
5,736,427 A 4/1998 Henderson
5,738,567 A 4/1998 Manzonie et al.
5,747,386 A 5/1998 Moore
5,779,522 A 7/1998 Walker et al.
5,782,675 A 7/1998 Southwick
5,792,709 A 8/1998 Robinson et al.
5,795,218 A 8/1998 Doan et al.
5,795,495 A 8/1998 Meikle
5,801,066 A 9/1998 Meikle
5,807,165 A 9/1998 Uzoh et al.
5,823,855 A 10/1998 Robinson
5,830,806 A 11/1998 Hudson et al.
5,833,519 A 11/1998 Moore
5,842,909 A 12/1998 Sandhu et al.
5,846,336 A 12/1998 Skrovan
5,851,135 A 12/1998 Sandhu et al.
5,868,896 A 2/1999 Robinson et al.
5,871,392 A 2/1999 Meikle et al.
5,879,222 A 3/1999 Robinson
5,879,226 A 3/1999 Robinson
5,882,248 A 3/1999 Wright et al.
5,893,754 A 4/1999 Robinson et al.
5,895,550 A 4/1999 Andreas
5,910,043 A 6/1999 Manzonie et al.
5,919,082 A 7/1999 Walker et al.
5,934,980 A 8/1999 Koos et al.
5,938,801 A 8/1999 Robinson
5,945,347 A 8/1999 Wright
5,954,912 A 9/1999 Moore
5,967,030 A 10/1999 Blalock
5,972,792 A 10/1999 Hudson
5,975,994 A 11/1999 Sandhu et al.
5,976,000 A 11/1999 Hudson
5,980,363 A 11/1999 Meikle et al.
5,981,396 A 11/1999 Robinson et al.
5,989,470 A 11/1999 Doan et al.
5,990,012 A 11/1999 Robinson et al.
5,994,224 A 11/1999 Sandhu et al.
5,997,384 A 12/1999 Blalock
6,004,196 A 12/1999 Doan et al.
6,036,586 A 3/2000 Ward
6,039,633 A 3/2000 Chopra
6,040,245 A 3/2000 Sandhu et al.
6,054,015 A 4/2000 Brunelli et al.
6,062,958 A 5/2000 Wright et al.
6,066,030 A 5/2000 Uzoh
6,074,286 A 6/2000 Ball
6,083,085 A 7/2000 Lankford
6,090,475 A 7/2000 Robinson et al.
6,099,393 A * 8/2000 Katagiri et al. ..... 451/56
6,110,820 A 8/2000 Sandhu et al.
6,116,988 A 9/2000 Ball
6,120,354 A 9/2000 Koos et al.
6,135,856 A 10/2000 Tjaden et al.
6,136,043 A 10/2000 Robinson et al.
6,139,402 A 10/2000 Moore
6,143,123 A 11/2000 Robinson et al.
6,143,155 A 11/2000 Adams et al.
6,152,808 A 11/2000 Moore
6,176,763 B1 1/2001 Kramer et al.
6,176,992 B1 1/2001 Talieh
6,179,693 B1 * 1/2001 Beardsley et al. ..... 451/56
6,180,525 B1 1/2001 Morgan
6,186,870 B1 2/2001 Wright et al.
6,187,681 B1 2/2001 Moore
6,191,037 B1 2/2001 Robinson et al.
6,193,588 B1 2/2001 Carlson et al.
6,196,899 B1 3/2001 Chopra et al.
6,200,901 B1 3/2001 Hudson et al.
6,203,404 B1 3/2001 Joslyn et al.
6,203,407 B1 3/2001 Robinson
6,203,413 B1 3/2001 Skrovan
6,206,754 B1 3/2001 Moore
6,206,756 B1 3/2001 Chopra et al.
6,206,759 B1 3/2001 Agarwal et al.
6,210,257 B1 4/2001 Carlson
6,213,845 B1 4/2001 Elledge
6,218,316 B1 4/2001 Marsh
6,220,934 B1 4/2001 Sharples et al.
6,224,466 B1 5/2001 Walker et al.
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,238,270 B1 5/2001 Robinson
6,244,944 B1 6/2001 Elledge
6,250,994 B1 6/2001 Chopra et al.
6,251,785 B1 6/2001 Wright
6,254,460 B1 7/2001 Walker et al.
6,261,151 B1 7/2001 Sandhu et al.
6,261,163 B1 7/2001 Walker et al.
6,267,650 B1 7/2001 Hembree
6,273,786 B1 8/2001 Chopra et al.
6,273,796 B1 8/2001 Moore
6,273,800 B1 8/2001 Walker et al.
6,276,996 B1 8/2001 Chopra
6,277,015 B1 8/2001 Robinson et al.
6,284,660 B1 9/2001 Doan
6,290,579 B1 9/2001 Walker et al.
6,296,557 B1 10/2001 Walker
6,306,008 B1 10/2001 Moore
6,306,012 B1 10/2001 Sabde
6,306,014 B1 10/2001 Walker et al.
6,306,768 B1 10/2001 Klein
6,309,282 B1 10/2001 Wright et al.
6,312,558 B1 11/2001 Moore
6,313,038 B1 11/2001 Chopra et al.
6,325,702 B1 12/2001 Robinson
6,328,632 B1 12/2001 Chopra
6,331,135 B1 12/2001 Sabde et al.
6,331,136 B1 * 12/2001 Bass et al. ..... 451/56
6,331,139 B1 12/2001 Walker et al.
6,331,488 B1 12/2001 Doan et al.
6,338,667 B1 1/2002 Sandhu et al.
6,350,180 B1 2/2002 Southwick
6,350,691 B1 2/2002 Lankford
6,352,466 B1 3/2002 Moore
6,352,470 B1 3/2002 Elledge
6,354,919 B1 3/2002 Chopra
6,354,923 B1 3/2002 Lankford
6,354,930 B1 3/2002 Moore
6,358,122 B1 3/2002 Sabde et al.
6,358,127 B1 3/2002 Carlson et al.
6,358,129 B1 3/2002 Dow
6,361,400 B1 3/2002 Southwick
6,361,411 B1 3/2002 Chopra et al.
6,361,413 B1 3/2002 Skrovan
6,361,417 B1 3/2002 Walker et al.
6,361,832 B1 3/2002 Agarwal et al.
6,364,749 B1 4/2002 Walker
6,364,757 B1 4/2002 Moore
6,368,190 B1 4/2002 Easter et al.
6,368,193 B1 4/2002 Carlson et al.
6,368,194 B1 4/2002 Sharples et al.
6,368,197 B1 4/2002 Elledge
6,376,381 B1 4/2002 Sabde
6,409,586 B1 6/2002 Walker et al.

* cited by examiner

APPARATUSES AND METHODS FOR CONDITIONING POLISHING PADS USED IN POLISHING MICRO-DEVICE WORKPIECES

TECHNICAL FIELD

The present invention relates to apparatuses and methods for conditioning polishing pads used in polishing micro-device workpieces.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpiece 12 (indicated by arrow J) and/or reciprocate the workpiece 12 back and forth (indicated by arrow I).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the micro-device workpiece 12 with the CMP machine 10, the carrier head 30 presses the workpiece 12 face-down against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42. As the micro-device workpiece 12 rubs against the planarizing surface 42, the planarizing medium removes material from the face of the workpiece 12.

The CMP process must consistently and accurately produce a uniformly planar surface on the micro-device workpiece 12 to enable precise fabrication of circuits and photo-patterns. One problem with conventional CMP methods is that the planarizing surface 42 of the planarizing pad 40 can wear unevenly, causing the pad 40 to have a non-planar planarizing surface 42. Another concern is that the surface texture of the planarizing pad 40 may change non-uniformly over time. Still another problem with CMP processing is that the planarizing surface 42 can become glazed with accumulations of planarizing solution 44, material removed from the micro-device workpiece 12, and/or material from the planarizing pad 40.

To restore the planarizing characteristics of the planarizing pad 40, the accumulations of waste matter are typically removed by conditioning the planarizing pad 40. Conditioning involves delivering a conditioning solution to chemically remove waste material from the planarizing pad 40 and moving a conditioner 50 across the pad 40. The conventional conditioner 50 includes an abrasive end effector 51 generally embedded with diamond particles and a separate actuator 55 coupled to the end effector 51 to move it rotationally, laterally, and/or axially, as indicated by arrows A, B, and C, respectively. The typical end effector 51 removes a thin layer of the planarizing pad material in addition to the waste matter to form a more planar, clean planarizing surface 42 on the planarizing pad 40.

One drawback of conventional methods for conditioning planarizing pads is that waste material may not be completely removed from the pad because the conditioning solution is not uniformly distributed across the pad, and thus, the waste material may not be completely removed from the pad. Typically, the conditioning solution is delivered at a fixed location near the center of the planarizing pad and moves radially outward due to the centrifugal force caused by the rotating pad. As a result, the region of the pad radially inward from the delivery point does not receive the conditioning solution. Moreover, the concentration of active chemicals in the conditioning solution decreases as the solution moves toward the perimeter of the pad. The centrifugal force also may not distribute the conditioning solution uniformly across the pad. Accordingly, there is a need to improve the conventional conditioning systems.

SUMMARY

The present invention is directed to apparatuses and methods for conditioning polishing pads used in polishing micro-device workpieces. In one embodiment, an end effector for conditioning a polishing pad includes a member having a first surface and a plurality of contact elements projecting from the first surface. The member also includes a plurality of apertures configured to flow a conditioning solution onto the polishing pad. In one aspect of this embodiment, the apertures can extend from the first surface to a second surface opposite the first surface. The apertures can also be arranged in a generally uniform pattern. In another aspect of this embodiment, the member further includes a manifold in fluid communication with the apertures.

In another embodiment of the invention, a conditioner for conditioning the polishing pad includes an arm having at least one spray nozzle configured to spray a conditioning solution onto the polishing pad and an end effector coupled to the arm. The end effector includes a first surface and a plurality of contact elements projecting from the first surface. In one aspect of this embodiment, the spray nozzle can be a first spray nozzle configured to spray conditioning solution onto the polishing pad at a first mean radius, and the conditioner can further include a second spray nozzle configured to spray conditioning solution onto the polishing pad at a second mean radius. In another aspect of this embodiment, the arm is configured to sweep the end effector across the polishing pad to dispense conditioning solution across the pad. The conditioner and/or the polishing pad is movable relative to the other to rub the plurality of contact elements against the pad.

In an additional embodiment of the invention, an apparatus for conditioning the polishing pad includes a table having a support surface, a polishing pad coupled to the support surface of the table, a source of conditioning solution, a micro-device workpiece carrier, and a conditioner. The micro-device workpiece carrier includes a spray nozzle that is operatively coupled to the source of conditioning solution by a fluid line and configured to flow a conditioning solution onto the polishing pad during conditioning. The conditioner includes an end effector and a drive system coupled to the end effector. The end effector has a first surface and a plurality of contact elements projecting from the first surface. The conditioner and/or the table is movable relative to the other to rub the plurality of contact elements against the polishing pad. In one aspect of this embodiment, the micro-device workpiece carrier can be configured to sweep across the polishing pad for uniform delivery of the conditioning solution.

In another embodiment of the invention, an apparatus for conditioning the polishing pad includes a source of conditioning solution, an arm, an end effector carried by the arm, and a fluid dispenser on the arm and/or the end effector. The end effector has a contact surface and a plurality of abrasive elements projecting from the contact surface. The fluid dispenser is operatively coupled to the source of conditioning solution by a fluid line. The fluid dispenser can comprise an aperture in the contact surface of the end effector and/or a spray nozzle on the arm and/or the end effector.

In another embodiment of the invention, an apparatus for conditioning the polishing pad includes a table having a support surface, a polishing pad coupled to the support surface of the table, a fluid arm positioned proximate to the polishing pad, and a conditioner. The fluid arm has a first spray nozzle, a second spray nozzle, and a fluid manifold that delivers fluid to the spray nozzles. The first spray nozzle is configured to flow a conditioning solution onto the polishing pad at a first mean radius, and the second spray nozzle is configured to flow the conditioning solution onto the polishing pad at a second mean radius different from the first mean radius. The conditioner includes an end effector and a drive system coupled to the end effector. The end effector has a first surface and a plurality of contact elements projecting from the first surface. The conditioner and/or the table is movable relative to the other to rub the plurality of contact elements against the polishing pad.

DETAILED DESCRIPTION

The present invention is directed toward apparatuses and methods for conditioning polishing pads used in polishing micro-device workpieces. The term "micro-device workpiece" is used throughout to include substrates in and/or on which microelectronic devices, micro-mechanical devices, data storage elements, and other features are fabricated. For example, micro-device workpieces can be semiconductor wafers, glass substrates, insulated substrates, or many other types of substrates. Furthermore, the terms "planarizing" and "planarization" mean either forming a planar surface and/or forming a smooth surface (e.g., "polishing"). Several specific details of the invention are set forth in the following description and in FIGS. 2A–8 to provide a thorough understanding of certain embodiments of the invention. One skilled in the art, however, will understand that the present invention may have additional embodiments, or that other embodiments of the invention may be practiced without several of the specific features explained in the following description.

Figure 1:
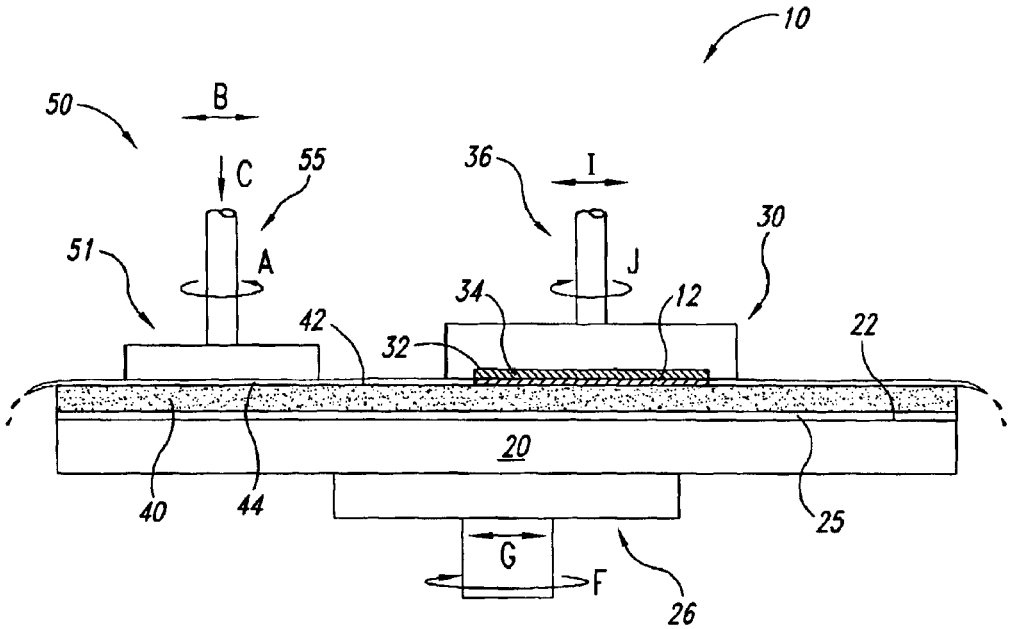
Fig. 1 (Prior Art)
FIG. 1 is a schematic cross-sectional view of a portion of a rotary planarizing machine and an abrasive end effector in accordance with the prior art.
Figure 2A:
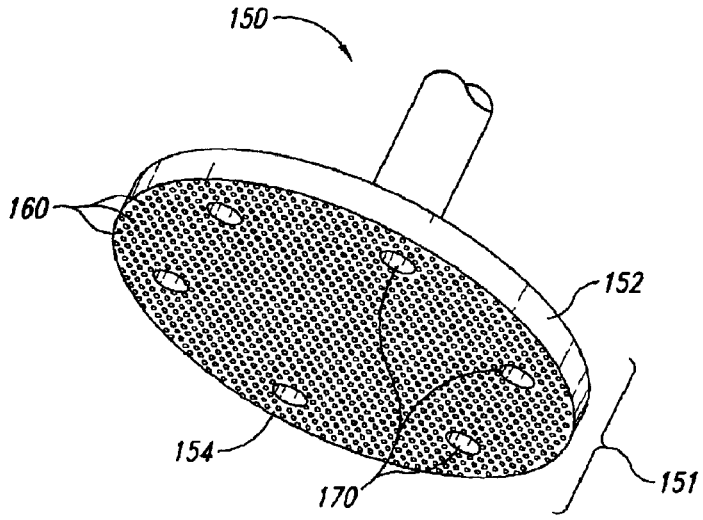
FIG. 2A is a bottom isometric view of a conditioner in accordance with one embodiment of the invention.

FIG. 2A is a bottom isometric view of a conditioner 150 in accordance with one embodiment of the invention. The conditioner 150 can be coupled to a CMP machine, such as the CMP machine 10 discussed above with reference to FIG. 1. The conditioner 150 includes an end effector 151 for refurbishing the planarizing pad on the CMP machine to bring the planarizing surface of the pad to a desired state for consistent performance.

In the illustrated embodiment, the end effector 151 includes a plate 152 and a plurality of contact elements 160 projecting from the plate 152. The plate 152 can be a circular member having a contact surface 154 configured to contact the planarizing surface of the planarizing pad. The contact elements 160 can be integral portions of the plate 152 or discrete elements such as bristles coupled to the plate 152. In the illustrated embodiment, the contact elements 160 are small diamonds attached to the contact surface 154 of the plate 152.

Figure 2B:
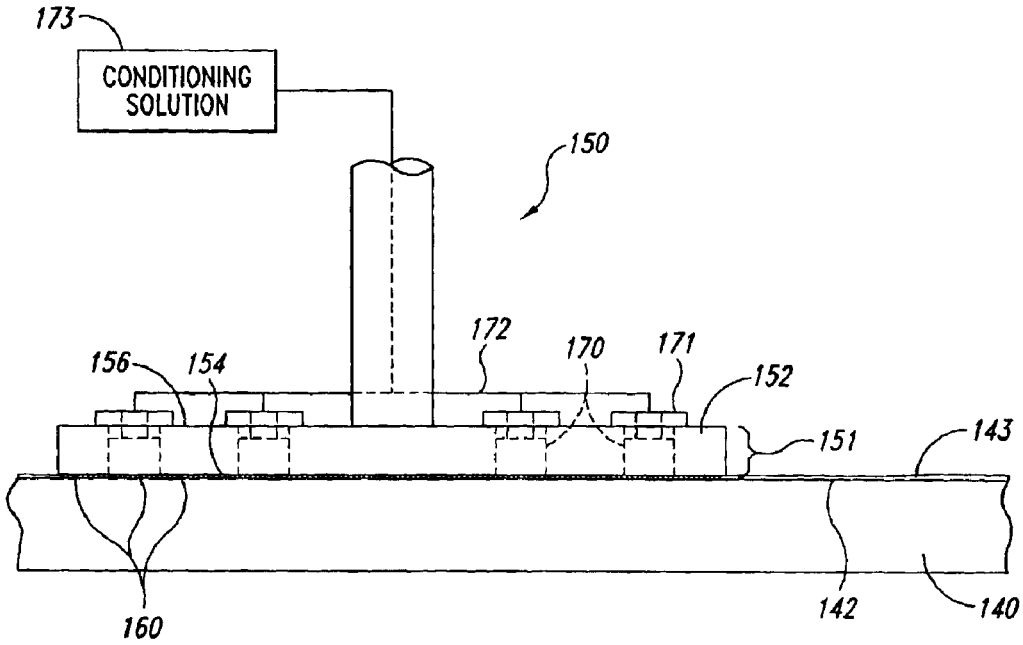
FIG. 2B is a schematic side view of the conditioner of FIG. 2A in operation on a planarizing pad.

FIG. 2B is a schematic side view of the conditioner 150 of FIG. 2A and a planarizing pad 140. Referring to FIGS. 2A and 2B, the end effector 151 also includes a plurality of apertures 170 in the contact surface 154. In the illustrated embodiment, the apertures 170 extend between the contact surface 154 and an upper surface 156 opposite the contact surface 154. The conditioner 150 can also have a fitting 171 coupled to each aperture 170 and hoses or lines 172 coupled to the fittings 171 (FIG. 2B). The apertures 170 can be fluid dispensers receiving a flow of conditioning solution 143 (FIG. 2B) from the lines 172 and distributing the conditioning solution 143 to a planarizing surface 142 of the planarizing pad 140 during conditioning. The apertures 170 can be arranged in a generally uniform pattern on the contact surface 154 to create a generally uniform distribution of conditioning solution 143 across the portion of the planarizing surface 142 proximate to the contact surface 154 of the end effector 151. In other embodiments, such as the embodiment described below with reference to FIG. 4, the apertures can be arranged in a different pattern and/or can have different sizes. In additional embodiments, such as the embodiment described below with reference to FIG. 3, the apertures may not extend between the contact surface 154 and the upper surface 156.

In operation, the apertures 170 are coupled to a conditioning solution supply source 173 (shown schematically in FIG. 2B) by the fittings 171 and lines 172 to distribute the conditioning solution 143 to the interface between the contact surface 154 of the end effector 151 and the planarizing surface 142 of the planarizing pad 140. More specifically, as the end effector 151 rotates, the conditioning solution 143 flows through the apertures 170 and onto the planarizing surface 142 of the planarizing pad 140 to remove waste material from the pad 140.

The conditioning solution is selected to be compatible with the planarizing pad material and enhance the removal of waste material on the planarizing surface. The conditioning solution typically dissolves the waste material, lubricates the interface between the end effector and the pad, and/or weakens the adhesion between the waste material and the pad. For example, in one embodiment, a suitable conditioning solution for removing copper waste material, such as copper oxide or copper chelates, from a planarizing pad is ammonium citrate manufactured by Air Liquide American L.P. of Houston, Tex., under the product number MD521. In other embodiments, other suitable conditioning solutions can be used.

One advantage of the embodiment illustrated in FIGS. 2A and 2B is that the apertures 170 provide a uniform distribution of conditioning solution 143 between the end effector 151 and the planarizing pad 140 as the conditioner 150 moves across the planarizing pad 140. Furthermore, the concentration of active chemicals in the conditioning solution 143 between the end effector 151 and the planarizing pad 140 is approximately the same at any position on the planarizing pad 140. Another advantage of the illustrated embodiment is that the apertures 170 provide conditioning solution 143 to the interface between the end effector 151 and the planarizing pad 140 when the conditioner 150 conditions the planarizing pad 140 including the center and the perimeter of the pad 140.

Figure 3:
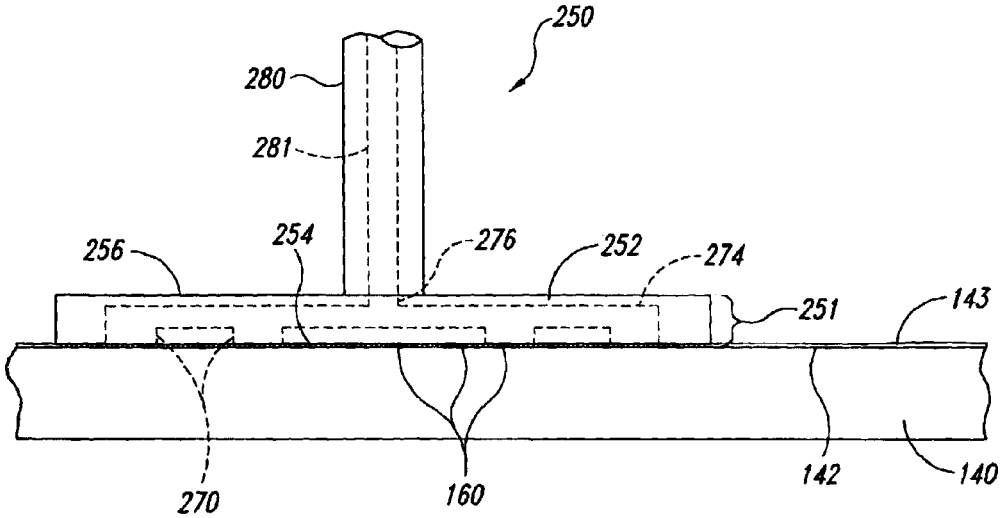
FIG. 3 is a schematic side view of a conditioner having an end effector in accordance with another embodiment of the invention.

FIG. 3 is a schematic side view of a conditioner 250 having an end effector 251 and an arm 280 coupled to the end effector 251 in accordance with another embodiment of the invention. The end effector 251 includes a plate 252 and contact elements 160 projecting from the plate 252. The plate 252 includes a contact surface 254 having apertures 270, an upper surface 256, and a manifold 274 between the upper surface 256 and the contact surface 254. The manifold 274 delivers the conditioning solution 143 through the apertures 270 to the planarizing surface 142 of the planarizing pad 140. In the illustrated embodiment, the manifold 274 includes an inlet 276 coupled to a conditioning solution supply conduit 281 extending through the arm 280.

Figure 4:
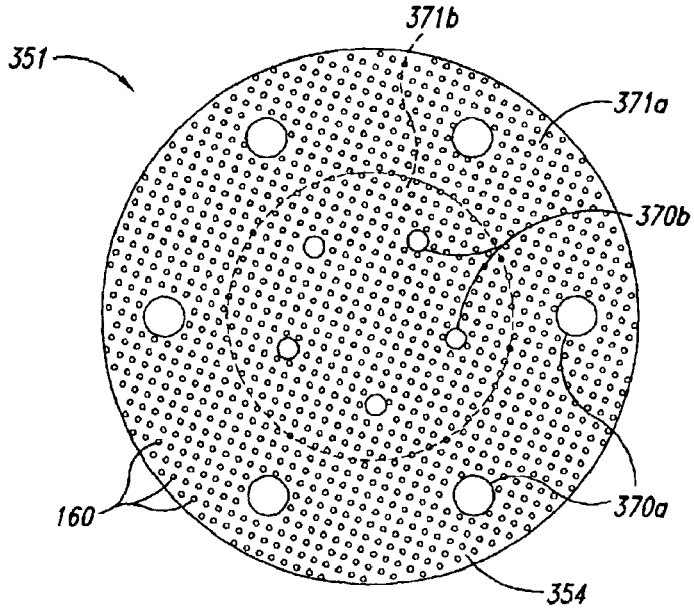
FIG. 4 is a bottom view of an end effector in accordance with another embodiment of the invention.

FIG. 4 is a bottom view of an end effector 351 in accordance with another embodiment of the invention. The end effector 351 includes a contact surface 354 and a plurality of contact elements 160 projecting from the contact surface 354. The end effector 351 also includes a plurality of first apertures 370*a* arranged within a first region 371*a* of the contact surface 354 and a plurality of second apertures 370*b* arranged within a second region 371*b* of the contact surface 354. The first apertures 370*a* are configured to provide a first volume of conditioning solution to the portion of the planarizing pad proximate to the first region 371*a* of the contact surface 354. The second apertures 370*b* are configured to provide a second volume of conditioning solution to the portion of the planarizing pad proximate to the second region 371*b* of the contact surface 354. The second volume of conditioning solution is less than the first volume because the second region 371*b* has a smaller area than the first region 371*a*. To provide a greater volume of conditioning solution, the first apertures 370*a* can have a greater diameter or flow rate than the second apertures 370*b*, or the end effector 351 can have a greater number of first apertures 370*a* than second apertures 370*b*. Accordingly, the first and second apertures 370*a–b* provide a generally uniform distribution of conditioning solution across the planarizing pad proximate to the contact surface 354 during conditioning.

Figure 5:
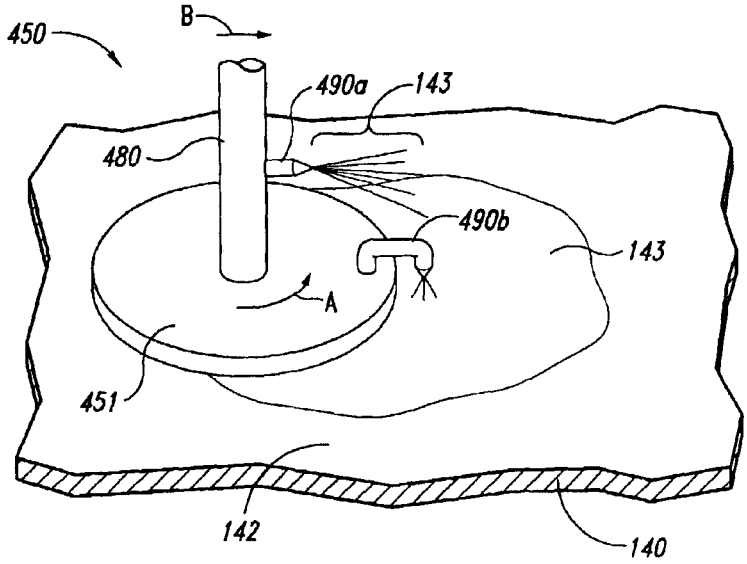
FIG. 5 is a schematic isometric view of a conditioner having a spray nozzle in accordance with another embodiment of the invention.

FIG. 5 is a schematic isometric view of a conditioner 450 having a spray nozzle 490 in accordance with another embodiment of the invention. The conditioner 450 includes an end effector 451, an arm 480 coupled to the end effector 451, and fluid dispensers such as spray nozzles (identified individual as 490*a–b*) coupled to the arm 480 and/or the end effector 451. In the illustrated embodiment, the conditioner 450 moves laterally in the direction B across the planarizing pad 140, and the spray nozzle 490*a* is configured to spray conditioning solution 143 in the direction B onto a portion of the planarizing pad 140 proximate to the end effector 451. Accordingly, the spray nozzles 490 spray conditioning solution 143 onto a portion of the planarizing pad 140 before the end effector 451 conditions the portion of the pad 140. In one embodiment, the arm 480 includes an internal actuator that rotates the end effector 451 in the direction A, thus enabling the spray nozzle 490*a* to be aimed in the direction of the leading edge of the conditioner 450.

Figure 6:
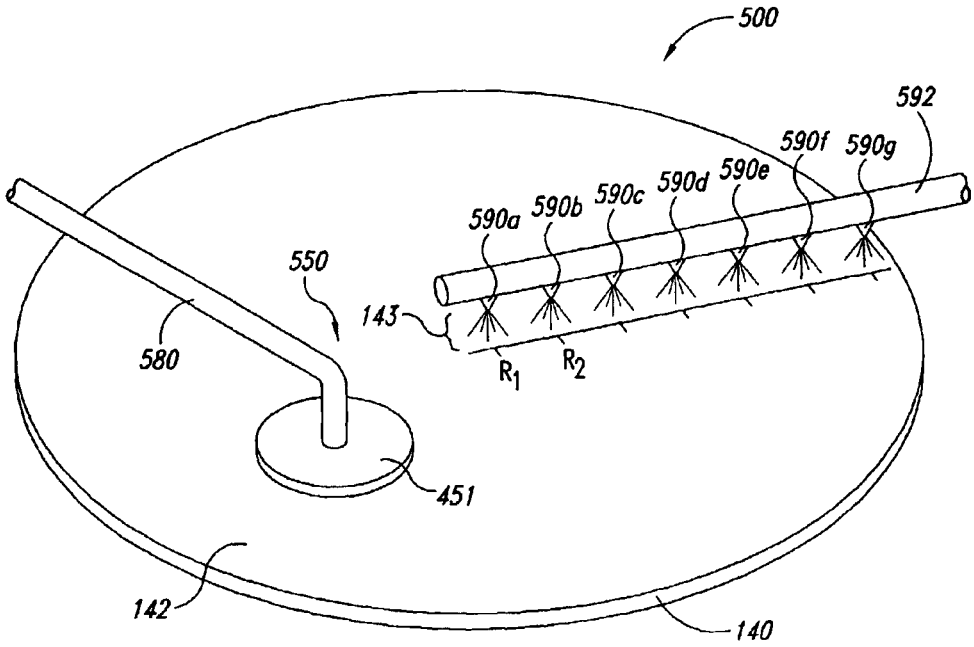
FIG. 6 is a schematic isometric view of a conditioning system including a conditioner and a fluid arm in accordance with another embodiment of the invention.

FIG. 6 is a schematic isometric view of a conditioning system 500 including a conditioner 550 and a fluid arm 592 in accordance with another embodiment of the invention. The conditioner 550 includes an end effector 451 and an arm 580 coupled to the end effector 451 to move the end effector 451 across the planarizing pad 140. The fluid arm 592 extends radially from the center of the planarizing pad 140 to the perimeter. The fluid arm 592 includes a plurality of spray nozzles (identified individually as 590*a–g*). Each spray nozzle 590 is configured to spray conditioning solution 143 at a specific mean radius of the planarizing pad 140. For example, the first spray nozzle 590*a* is configured to spray conditioning solution 143 at a first mean radius $R_1$ of the planarizing pad 140 and a second spray nozzle 590*b* is configured to spray conditioning solution 143 at a second mean radius $R_2$ different than the first mean radius $R_1$ of the planarizing pad 140. Similarly, the other spray nozzles 590 spray conditioning solution 143 onto the planarizing pad 140 at different mean radii. In one embodiment, the spray nozzles 590 near the perimeter of the planarizing pad 140 spray a greater volume of conditioning solution 143 to cover the correspondingly greater areas of the pad 140. Accordingly, the conditioning system 500 can provide conditioning solution 143 with a uniform distribution and a consistent concentration of active chemicals across the planarizing pad 140. In other embodiments, the fluid arm 592 can include a different number of spray nozzles 590, and/or the arm 592 can be movable relative to the planarizing pad 140.

Figure 7:
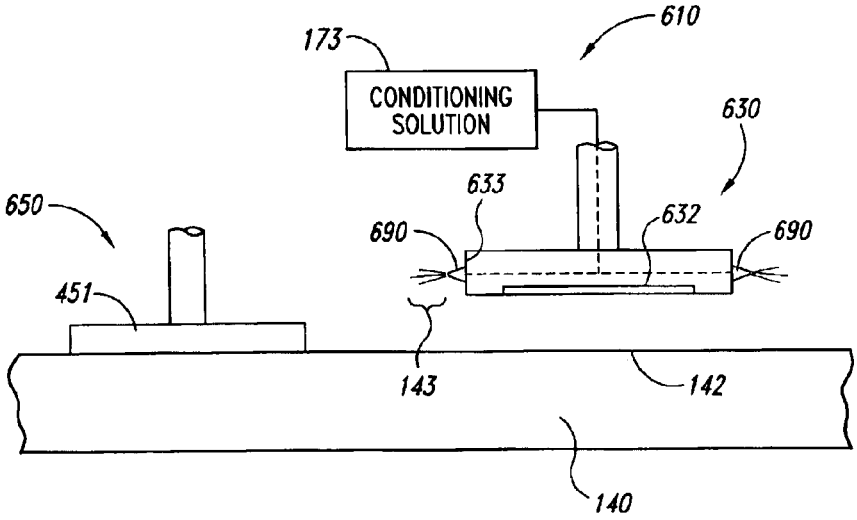
FIG. 7 is a schematic side view of a CMP machine and a conditioner in accordance with another embodiment of the invention.

FIG. 7 is a schematic side view of a CMP machine 610 and a conditioner 650 in accordance with another embodiment of the invention. The CMP machine 610 can be generally similar to the CMP machine 10 described above with reference to FIG. 1. For example, the CMP machine 610 can include a planarizing pad 140 and a micro-device workpiece carrier 630 having a lower surface 632 to which a micro-device workpiece is attached. The micro-device workpiece carrier 630 also includes a plurality of spray nozzles 690 coupled to a side surface 633. The spray nozzles 690 are coupled to the conditioning solution source 173 to spray conditioning solution 143 across the planarizing surface 142 of the planarizing pad 140 during conditioning. In one embodiment, the micro-device workpiece carrier 630 is spaced apart from the planarizing pad 140 and moves around the pad 140 with the conditioner 650 to provide conditioning solution 143 to portions of the planarizing pad 140 proximate to the end effector 451. In another embodiment, the micro-device workpiece carrier 630 moves radially across the planarizing pad 140. In any of these embodiments, the spray nozzles 690 on the micro-device workpiece carrier 630 provide a uniform distribution of conditioning solution 143 and a consistent concentration of active chemicals in the conditioning solution 143 to the interface between the end effector 451 and the planarizing pad 140 as the conditioner 650 moves across the pad 140.

Figure 8:
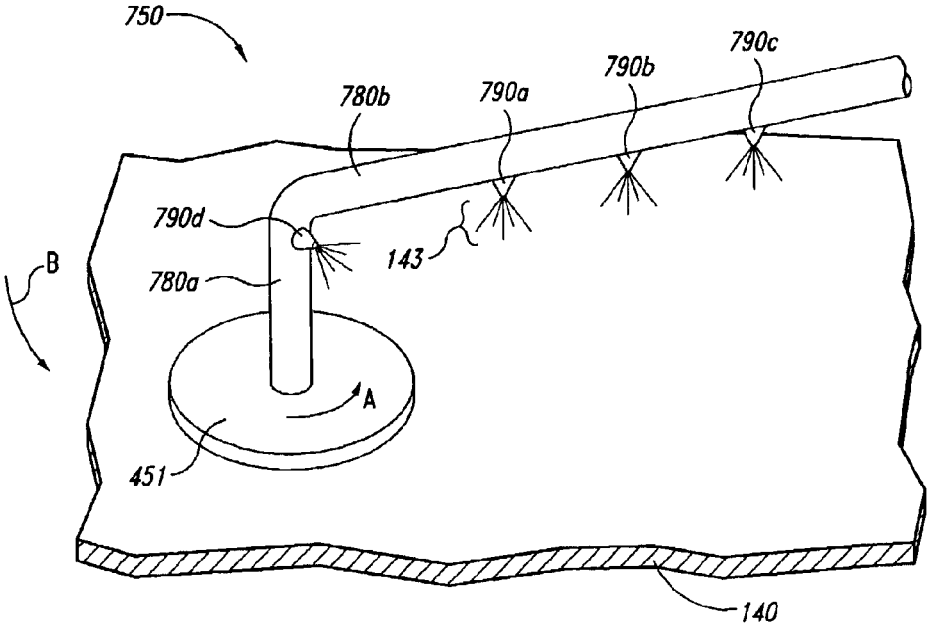
FIG. 8 is a schematic isometric view of a conditioner in accordance with another embodiment of the invention.

FIG. 8 is a schematic isometric view of a conditioner 750 in accordance with another embodiment of the invention. The conditioner 750 includes an end effector 451, a first arm 780*a* coupled to the end effector 451, and a second arm 780*b* coupled to the first arm 780*a*. The first and second arms 780*a–b* move the end effector 451 across the planarizing pad 140. More specifically, the first arm 780*a* rotates the end effector 451 in the direction A and the second arm 780*b* sweeps the end effector 451 across the planarizing pad 140 in the direction B. The first and second arms 780*a–b* can include a plurality of spray nozzles (identified individually as 790*a–d*) to spray conditioning solution 143 across the planarizing pad 140. The first, second, and third spray nozzles 790*a–c* are configured to spray conditioning solution 143 in a first direction generally perpendicular to the planarizing pad 140. A fourth spray nozzle 790*d* is configured to spray conditioning solution 143 in a second direction generally parallel to the planarizing pad 140. In additional embodiments, the first and second arms 780*a–b* can have a different number of spray nozzles 790, and the spray nozzles 790 can be oriented in different directions.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. An end effector for conditioning a polishing pad used in polishing a micro-device workpiece, the end effector comprising:

a member including a first surface and a plurality of apertures in the first surface configured to flow a conditioning solution to the polishing pad; and a plurality of rigid contact elements projecting from the first surface;

wherein the apertures comprise, a plurality of first apertures in a first region of the member and a plurality of second apertures in a second region of the member, wherein the plurality of first apertures is configured to provide a first volume of conditioning solution to the polishing pad, and wherein the plurality of second apertures is configured to provide a second volume of conditioning solution to the polishing pad, the second volume being different than the first volume.

2. The end effector of claim 1 wherein the first and second apertures are arranged in a generally uniform pattern to flow the conditioning solution generally uniformly across a portion of the polishing pad proximate to the first surface.

3. The end effector of claim 1 wherein the first and second apertures extend generally transverse to the first surface of the member to flow the conditioning solution to the first surface.

4. The end effector of claim 1 wherein the member further includes a manifold, and wherein the first and second apertures are in fluid communication with the manifold.

5. The end effector of claim 1, further comprising a spray nozzle coupled to the member, the spray nozzle being configured to spray the conditioning solution onto the polishing pad proximate to the member.

6. The end effector of claim 1 wherein the rigid contact elements comprises abrasive particles.

7. The end effector of claim 1 wherein the rigid contact elements comprises raised features.

8. An end effector for conditioning a polishing pad used in polishing a micro-device workpiece, the end effector comprising:

a plate including a first surface, a second surface opposite the first surface, a plurality of apertures extending from the first surface to the second surface, and fluid fittings at the apertures through which a conditioning solution can flow; and a plurality of rigid contact elements projecting from the first surface;

wherein the apertures comprises a plurality of first apertures in a first region of the plate and a plurality of second apertures in a second region of the plate, wherein the plurality of first apertures is configured to provide a first volume of conditioning solution to the polishing pad, and wherein the plurality of second apertures is configured to provide a second volume of conditioning solution to the polishing pad, the second volume being different than the first volume.

9. The end effector of claim 8 wherein the first and second apertures are arranged in a generally uniform pattern.

10. The end effector of claim 8, further comprising a spray nozzle coupled to the plate, the spray nozzle being configured to spray conditioning solution onto the polishing pad proximate to the plate.

11. An apparatus for conditioning a polishing pad used in polishing a micro-device workpiece, comprising:

an end effector having a first surface and a plurality of rigid contact elements projecting from the first surface; and means for providing an approximately equal volume of conditioning solution between the polishing pad and the first surface of the end effector at a first radius of the polishing pad and at a second radius different from the first radius of the polishing pad.

12. The apparatus of claim 11 wherein the means for providing comprises a spray nozzle at least proximate to the end effector.

13. The apparatus of claim 11 wherein the means for providing comprises an arm having a spray nozzle for spraying conditioning solution onto the polishing pad, and wherein the arm is coupled to the end effector.

14. The apparatus of claim 11 wherein the means for providing comprises a micro-device workpiece carrier having a spray nozzle for spraying conditioning solution onto the polishing pad, wherein the micro-device workpiece carrier is movable over the polishing pad.

15. An apparatus for conditioning a polishing pad used in polishing micro-device workpieces, the apparatus comprising:

a table having a support surface;

a polishing pad coupled to the support surface of the table;

a source of conditioning solution; and a conditioner including an end effector and a drive system coupled to the end effector, the end effector having a first surface, a plurality of apertures configured to flow a conditioning solution to the polishing pad, and a plurality of rigid contact elements from the first surface, wherein the apertures are operatively coupled to the source of conditioning solution wherein the apertures comprises a plurality of first apertures in a first region of the first surface, and a plurality of second apertures in a second region of the first surface, wherein the first apertures are configured to provide a first volume of conditioning solution to the polishing pad, wherein the second apertures are configured to provide a second volume of conditioning solution to the polishing pad, the second volume being different than the first volume, and wherein the conditioner and/or the table is movable relative to the other to rub the contact elements against the polishing pad.

16. The apparatus of claim 15 wherein the first and second apertures in the end effector are arranged in a generally uniform pattern to flow the conditioning solution generally uniformly across a portion of the polishing pad proximate to the first surface.

17. The apparatus of claim 15 wherein the conditioner further includes a manifold, and wherein the first and second apertures of the end effector are in fluid communication with the manifold.

18. The apparatus of claim 15, further comprising a spray nozzle coupled to the conditioner, the spray nozzle being configured to spray the conditioning solution onto the polishing pad proximate to the end effector.

19. The apparatus of claim 15 wherein the first and second apertures of the end effector are in the first surface of the end effector.

20. The apparatus of claim 15, further comprising an arm coupled to the conditioner to move the conditioner across the polishing pad, wherein the arm includes a spray nozzle to spray the conditioning solution onto the polishing pad.

21. An end effector for conditioning a polishing pad used in polishing a micro-device workpiece, the end effector comprising a generally planar surface, a plurality of apertures in the surface positioned to flow a conditioning solution onto the polishing pad, and a plurality of diamond articles embedded in the surface wherein at least a portion of the diamond particles project from the surface and are configured to abrade the polishing pad, wherein the apertures comprise a plurality of first apertures in a first region of the surface and a plurality of second apertures in a second region of the surface, wherein the plurality of first apertures is configured to provide a first volume of conditioning solution to the polishing pad, wherein the plurality of second apertures is configured to provide a second volume of conditioning solution to the polishing pad, the second volume being different than the first volume.

22. The end effector of claim 21 wherein the first and second apertures are arranged in a generally uniform pattern to flow the conditioning solution generally uniformly across a portion of the polishing pad proximate to the surface.

23. The end effector of claim 21, further comprising a plurality of fluid fittings at the first and second apertures through which the conditioning solution can flow.

24. The end effector of claim 21 wherein the first and second apertures extend generally transverse to the surface to flow the conditioning solution to the surface.

25. The end effector of claim 21, further comprising a manifold in fluid communication with the first and second apertures.

26. The end effector of claim 21, further comprising a spray nozzle configured to spray the conditioning solution onto the polishing pad proximate to the end effector.

* * * * *